US005233927A

United States Patent [19]

Wulvik

[11] Patent Number: 5,233,927

[45] Date of Patent: Aug. 10, 1993

[54] ARRANGEMENT IN A SMOKE CAMOUFLAGE SYSTEM

[75] Inventor: Erik Wulvik, Skedsmokorset, Norway

[73] Assignee: Raufoss A/S, Norway

[21] Appl. No.: 784,439

[22] PCT Filed: May 10, 1990

[86] PCT No.: PCT/NO90/00079

§ 371 Date: Nov. 8, 1991

§ 102(e) Date: Nov. 8, 1991

[87] PCT Pub. No.: WO90/13787

PCT Pub. Date: Nov. 15, 1990

[30] Foreign Application Priority Data

May 10, 1989 [NO] Norway ..... 891915

[51] Int. Cl.[5] ..... C06D 3/00

[52] U.S. Cl. ..... 102/334

[58] Field of Search ..... 102/334

[56] References Cited

FOREIGN PATENT DOCUMENTS 0108939 10/1983 European Pat. Off. .
492806 3/1930 Fed. Rep. of Germany .
657353 2/1938 Fed. Rep. of Germany .
3714454A1 4/1987 Fed. Rep. of Germany .
59443 2/1937 Norway .
58725 12/1937 Norway .
2000575A 1/1979 United Kingdom .

OTHER PUBLICATIONS

International Search Report.
International Preliminary Examination Report.

*Primary Examiner*—Peter A. Nelson
*Attorney, Agent, or Firm*—Larson and Taylor

[57] ABSTRACT

The present invention relates to an arrangement for a smoke camouflage system, preferably for the camouflaging and/or screening of point targets (8) in fortresses, airports or similar, especially against attacking precision guided weapons, and for the purpose of producing an effective system for emitting screening smoke comprising active screening materials, there is suggested that the arrangement comprises means for emitting screening smoke in the form of metallic powder, preferably brass powder, to which there is added a material for diluting and improving the cold-flowing properties thereof, for example aluminum silicate particles or a sand-blowing material, the devices for emitting the composition comprising one or more nozzles (6), preferably high pressure nozzles (1, 6) for emitting one or more spreading clouds.

22 Claims, 5 Drawing Sheets

ARRANGEMENT IN A SMOKE CAMOUFLAGE SYSTEM

FIELD OF THE INVENTION

The present invention concerns an arrangement in a smoke camouflage system, preferably for camouflaging and/or screening point targets on fortresses, air parts etc, especially against attacking precisely guided weapons.

The invention especially concerns a device for achieving an effective discharge of screening smoke, especially composition ratios for such smoke and nozzles and driving devices to be used for the most effective multispectral screening.

More specifically, the invention concerns the location of nozzles, trigging such nozzles, and guiding the screening smoke in dependence of meteorological parameters.

DISCLOSURE OF PRIOR ART

EP 0108939 concerns a launching device comprising packed metallic powder in the launching canister itself. The contents of the canister is dispersed through a detonation, and the effect of the powder charge comprising lamellated powder, will be reduced because the spreading rate is less for pure metallic powder alone.

It is true that EP 0108939 specifies that the exhaust gasses from the fuel for the launching canisters aids in blowing out the metallic powder, but such a spontaneous blowout can not be compared to continuous blowout from a pressure nozzle, as is the case with the present invention.

NO 58.725 concerns a process for producing smoke over sea, on land or in the air, and specifies a pure liquid being mixed with ambient air giving rise to smoke, something which is without interest in connection with nozzle-spreading of "cold-flowing" metallic powder for IR-screening and metal fibre/dipoles for mm-wave-screening.

NO 59.443 concerns a process for developing smoke by using a smoke-producing liquid, and represents a further development of the above mentioned NO patent 58.725, but gives no further information about the pure liquid which is to be mixed with the ambient air other than this being added colouring powder. The technique relating to this patent is thus scarcely suited for metallic particles, and nothing is specified about the production of a good "cold-flowing" powder composition.

GB 2000575 specifies a metal pressure cylinder expelling a metal powder composition, more specifically micro-fine powder with a particle diameter from 3 to 60 μm for estabishing a fog-like cloud for covering a target visually. The suggested powder is talc, caolin, potassium carbonate, magnesium carbonate, sodium hydrogen carbonates and other free-flowing powders or powders which have been made flowable, and which may produce a hanging cloud when being spread. However, there is not given any specification of the problems concerning the expelling of metallic powders, metallic particles not being mentioned at all, and even less the publication specifies metallic particles or dipoles being equipped with a suitable carrier, e.g. a sand-blowing composition which in its turn produces a "cold-flowing" composition giving the advantages being specified for the present invention.

Admittedly, there is suggested a pressure cylinder and a kind of "environmentally friendly" powder which after use fertilizes the ground, but there is no specification concerning nozzle-spreading of metallic powder for IR-screening (3–12 μm) and metallic fibres/dipoles for mm-wave screening (35–94 GHz) being blown through nozzles by using high-pressure air and with a simple automatical or manual dosing.

DE 3714454 specifies a two-component fog, especially comprising silicon tetrachloride and an ammonia-solution being suited for smoke-coverage rehersals and giving a purely visual protection. However, neither does this publication give any specification about how one may suitable discharge a powder charge which has added thereto a suitable filler by using high-pressure nozzles to produce a disperse composition of metallic powder for IR-screening and metallic fibres/dipoles for mm-wave screening. The known system is based on the production of a fog by liquids being misted through a stream of pressurized air, and this pressure is far less than what is needed for the present invention wherein the pressure may be compared to what is used for a sand-blowing technique, i.e. in the range of 5–7 bars.

DE 492806 also concerns a technique wherein there is produced a fog by using sulphurous acid and moist air, there being required two pressure cylinders, namely a first pressure container for the sulpurous acid and a second pressure container for moist pressurized air. This is different from the present system where the feeding may take place directly from a magazine containing the smoke material composition, and where the dosing only is dependent on this smoke material composition alone.

DE 657353 concerns a fog-generating apparatus comprising a container holding both fog moisture and pressurized gas, as opposed to what is suggested according to the present invention being based on a separate supply of pressurized air and a separate dosing of the present special smoke powder composition

SUMMARY OF THE INVENTION

Generally speaking, the invention is based on a suitable powder material composition for providing multispectral smoke screening from spreading nozzles driven with compressed air, and is particularly concerned with mixing a suitable additive material in the smoke powder charge proper.

The advantages being achieved by mixing a filler (e.g. a sand blowing material) into a smoke powder charge which may be a mixture of metallic powder for IR screening (3–14 μm) and metallic fibres/dipoles for mm-wave screening (e.g. 35–48 GHz) being blown out through nozzles by using high-pressurized air, are disclosed in the following.

i) By adding e.g. a sand blowing material into the smoke powder charge, there is achieved an excellent "cold-flowing" of the powder composition. Thereby it is relatively simple to construct a robust and reliable feeding (automatic) mechanism (without movable parts when a setting has been performed) giving an optimal smoke material feeding of the nozzles, based on signals from measuring apparatuses for the wind speed. There is avoided the use of hoppers which are necessary for feeding/dosing the active undiluted smoke material, e.g. a metallic powder/fibre mixture.

The feeding may be performed (without the use of movable parts) directly from the magazine containing the smoke material mixture. In other words, the system may be operated continuously, without operators, where only the magazine capacity limits the operating time. When the wind speed increases the consumption of smoke material will however increase. The magazine will thus become empty more quickly under such conditions if it is not replenished during the operation.

To construct a corresponding feeding automation for the undiluted smoke material will probably not be possible, or will at best represent very large problems. One has then to work with a non-flowing powder (metallic powder/fibre) and with a volume quantity of only a tenth to a fifth of the volume quantity of the preferred "easy-flowing" smoke powder composition. One must here thus use more narrow passages in the dosage system. A problem will be a very variable feeding on account of the "non-flowing" property of the metallic powder, and likewise that the fibre/dipole-component for mm wave screening may block the relatively narrow passages.

ii) If there is used brass powder for IR-screening, different types of the powder may show varying degrees of adhesion towards the filler material which may be grains of sand. The grains of sand having a high weight/surface area ratio (as opposed to the metallic powder in the form of flakes) will be flung significantly further from the nozzle than the brass flakes. By choosing brass powder with a suitable adhesion, the brass flakes will become "peeled off" from the grains of sand during their flight with a consequently greater spreading of the flakes. The succeeding grains of sand will also, due to the turbulence effect, "push" the cloud of dust further away from the nozzle. This effect is especially prevalent when there is no wind or little wind. (At a greater wind velocity the wind will also contribute to a "post-spreading" of the cloud.)

iii) The dilution of the smoke powder will also reduce the size of the powder agglomerates in the air and thus achieve a greater screening effect per weight unit of smoke material. This is due to a more effective splitting up of the powder (the part that is not adhered to the grains) in the nozzle opening when the powder concentration in the air current is reduced.

The invention is disclosed in greater detail in the following description, the contents of which are given on the next page, and which describes different embodiments of the invention.

BRIEF DISCLOSURE OF THE DRAWINGS

DISCLOSURE OF EMBODIMENTS

Figure 1:
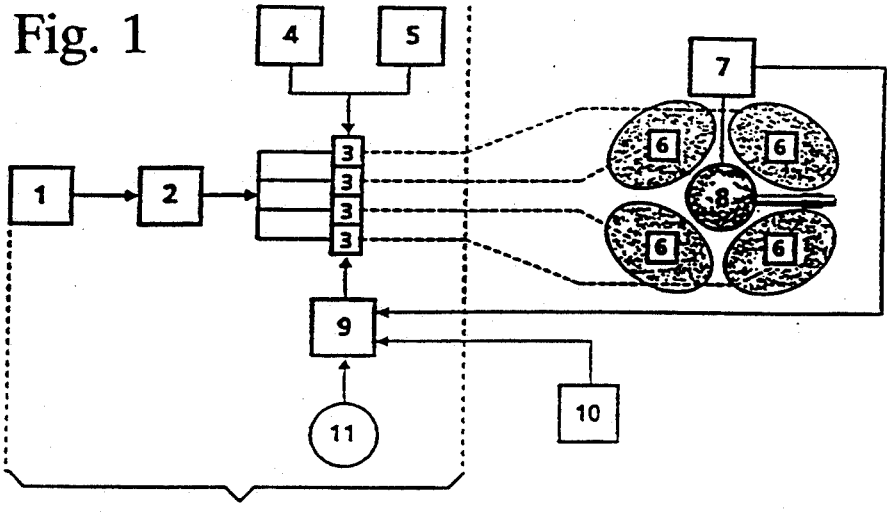
FIG. 1 shows an outlined suggestion for a smoke system for screening objects, e.g. guns.

In the following there will be disclosed different embodiments of the present device for a smoke-screening system. In such a system there are inter alia made the following requirements.

a) The smoke system is to maintain, with a large degree of probability (>90%) in a wind strength of up to 8 m/s across the direction of attack, an effective smoke screen between incoming rocket/laser designator and the gun, in the last phase of the flight time of the rocket, approx. 10–15 s.

b) Point 1) is also to be fulfilled if two or more rockets from different directions simultaneously are on their way towards the gun (the fortress).

c) The smoke screen is to protect against laser-guided, TV-guided and advanced picture-forming IR-target seekers.

d) The smoke system may be used for training in times of peace with a smoke material which is environmentally acceptable.

e) The smoke system may in its entirety be operated from protected quarters.

f) The vulnerability of the smoke system towards any air attack should be equal or less than for the gun itself. (Even if the gun is out of commission the smoke system should still be able to be used as a decoy to suggest the gun's apparent combat value.)

g) The smoke should be least apparent in the visible and infra-red wave spectrum.

A complete smoke system should further comprise two subsystems, namely one for the warning of an attack and one for producing smoke.

The present system is based on pressurized air blowing smoke material out through immobile smoke points on the ground.

The rest of the system is protected in rock. A smoke point may consist of several nozzles blowing smoke in given directions. Each object or gun which is to be protected, has a system of smoke points protecting against attack from all directions.

The system should comprise elements giving a reaction time in the order of 5–10 s from activation to complete smoke screening.

Thus, the screening should start at a comparatively early point of time in the attack phase, based on a somewhat more uncertain information about air attack. The following warning systems or combinations thereof should accordingly be of interest:

i) Laser detector mounted on the gun.

ii) Detection of incoming attacking planes through a suitable radar system. If the fortress has an air-raid radar, this may be used as well.

iii) Placing of observation posts on strategically chosen locations, on the perimeter or outside the defence area of the fortress.

By laser illumination of a gun, laser detectors may automatically activate the corresponding smoke system.

Smoke screening based on warning by airplane radar from planes and/or observation posts in the terrain, must be performed for example through firing leading officers giving orders for smoke-screening before a possible attack is expected to be initiated. In this case windward smoke points are activated. The concentration of smoke will be "correctly" adjusted according to the wind conditions through a dosage valve being directed by a device measuring the wind velocity.

The area over which the guns inside a fortress are spread, will be relatively large compared to the smoke area necessary for hiding a gun. The screening object will thus be the guns and not the fortress itself. Thus, it is avoided that too much smoke is emitted. Too much smoke may give an unwanted marking of the fortress and also give disturbances on one's own sensors. As a consequence thereof each gun ought to have its own smoke system.

The smoke screening system should therefore produce a screening aerosol through the spreading of a smoke material. A suitable smoke material will be present in the form of dust or powder. The activation of of the system may thus be done either automatically or manually. All other functions are to be performed via automations.

Figure 2:
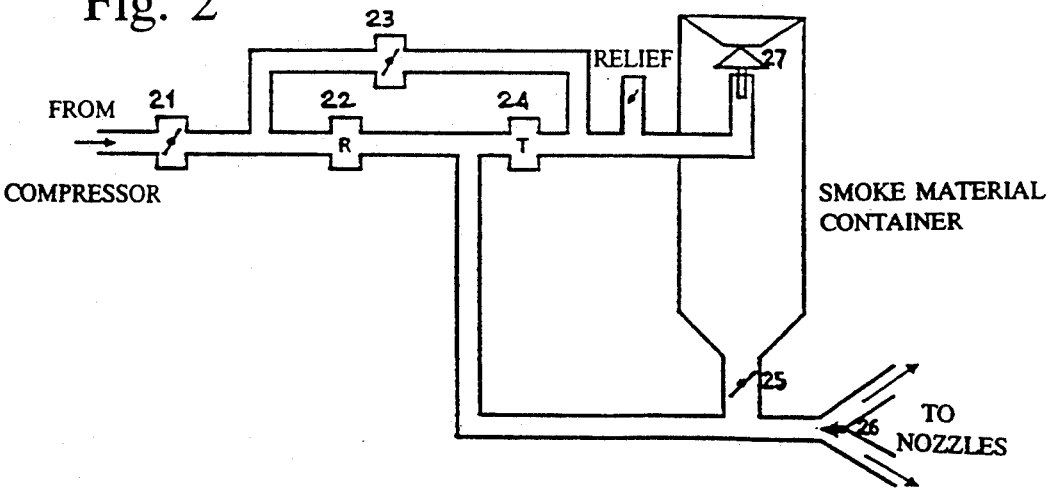
FIG. 2 shows a flow diagram for transport of pressurized air and smoke material to the nozzles.

Suggestions for a smoke system concept are outlined in FIGS. 1 and 2.

MODE OF OPERATION

Referring to FIG. 1 and 2 there will in the following de given a description of the functions of the system.

A compressor 1, FIG. 1, may continuously idle in the alert period. If it is found advantageous, the pressurized air from the compressor 1 will be stripped for water and oil in the filter unit 2, FIG. 1.

Figure 3:
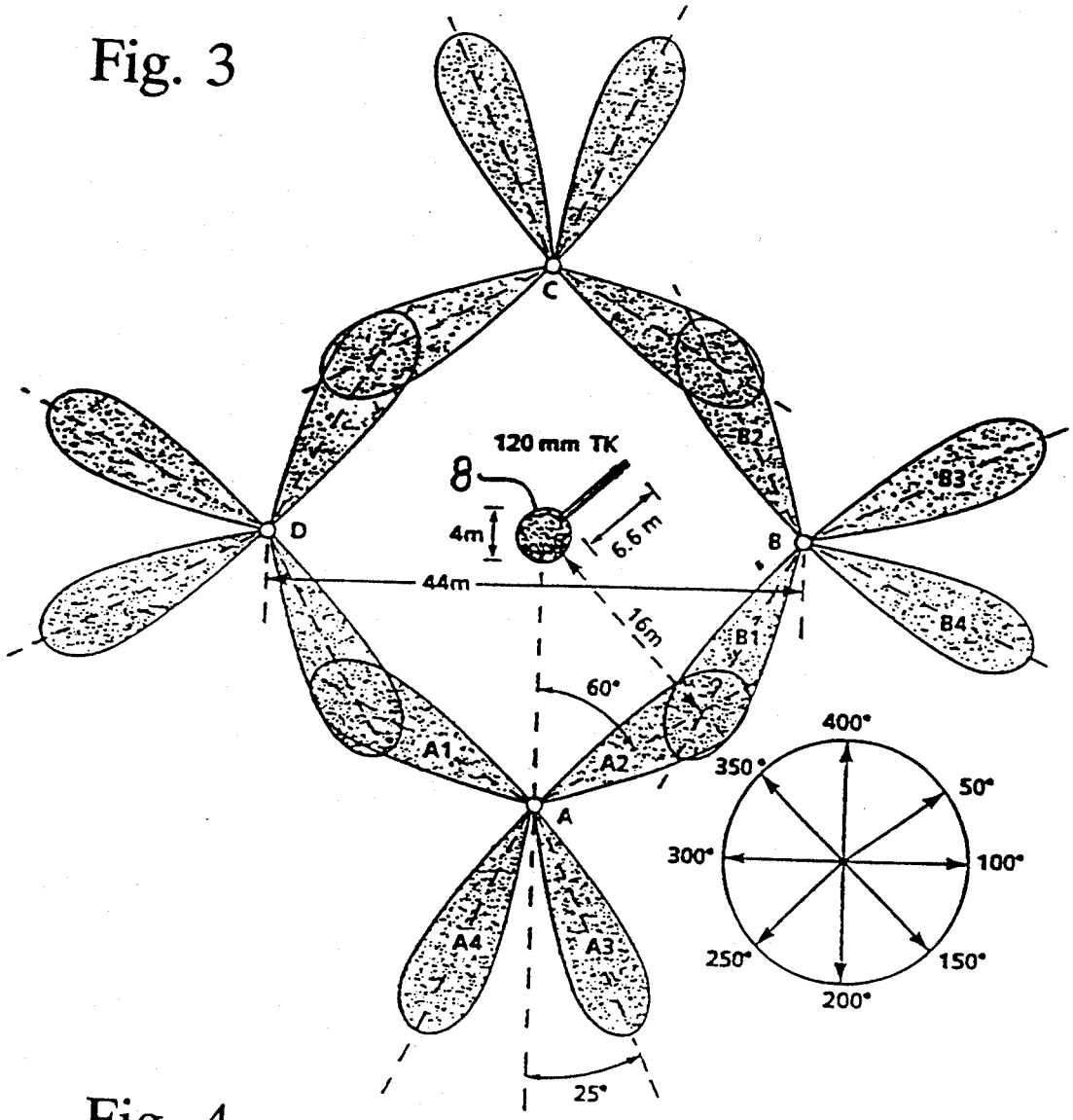
FIG. 3 shows an example of locating four smoke points around a tower gun with four spread clouds of smoke in each smoke point.
Figure 4:
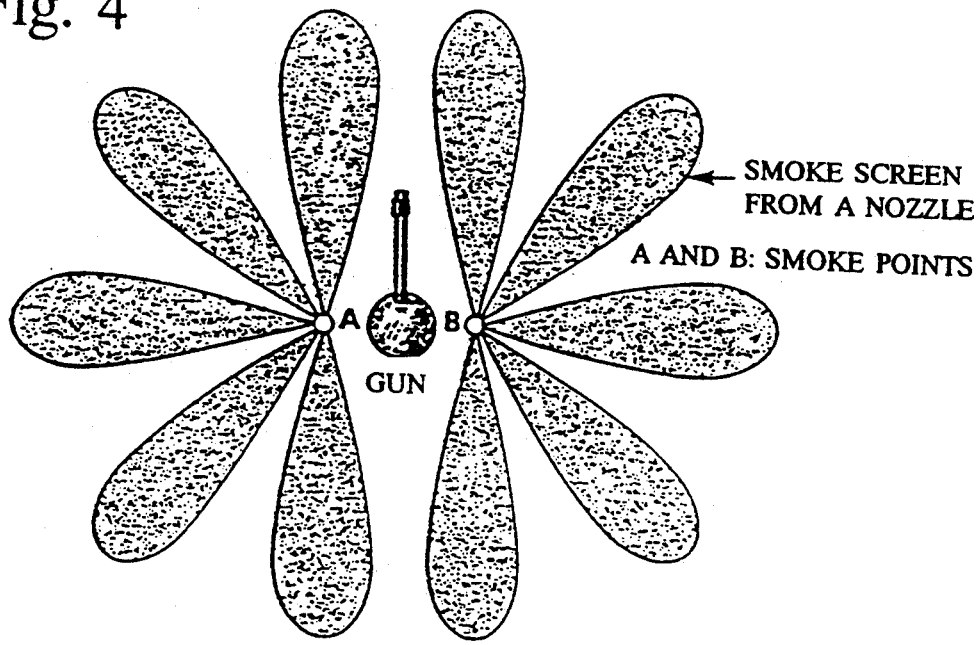
FIG. 4 shows an example of locating two smoke points where the terrain makes the locating of several smoke points with a greater spreading difficult.

Around the gun 8 there are situated smoke points 6 which may be armoured, see FIG. 2 (see also FIG. 3 and FIG. 4). In these smoke points there are mounted nozzles with different emitting directions. The nozzles are supplied with air and smoke powder through pipes in the rock from the dosage system 3, FIG. 1. In each smoke point there are advantageously at least four nozzles. In most cases each pipeline will serve two nozzles (only in exceptional cases one nozzle). These nozzle pairs may then be activated independently from each other from the controlling valves 3, FIG. 1. The function of these valves is described in detail in connection with FIG. 2.

When starting up the system, the valves 21, 23 and 25, FIG. 2, are opened. The valve 21 opens for the pressurized air from the compressor. The valve 23 is chronometrically controlled and gives a high pressure in the container for the smoke material for rapid feeding of the nozzles during start. Simultaneously the valve 25 is adjusted automatically for a high dosage via signals from the controlling unit 9, FIG. 1. When a covering smoke cloud has been established (during 5–10 s), the valve 23 closes, FIG. 2. Simultaneously the valve 25 is adjusted for a maintenance dosage. This is adjusted according to maximum wind speed based on signals from a wind measuring apparatus 10, FIG. 1. During operation the pressurized air passes valve 22 alone, FIG. 2, and the nozzle pressure is thereby reduced. When stopping the system the manual operating unit 11, FIG. 1, is adjusted, and valves 21 and 25, FIG. 2, are being closed.

At automatic activation the system will be turned on when the gun is illuminated by a laser beam. The laser warner 7, FIG. 1, registers that the gun is illuminated and from which direction the illumination originates. This gives signals to the controlling unit 9, FIG. 1, which initiates the starting procedure for the nozzle system giving smoke screening in the angle sector (90°–120°) covering the laser illumination independently from the wind direction. If the wind has the same direction as the incoming laser beam, the wind will blow the smoke cloud towards the gun which after a little while will be surrounded by smoke. The feeding of the activated nozzles will thereafter be reduced and the system will go into operation modus. Correct dosage will be adjusted according to a smoke cloud with an effective depth equal to the distance from the smoke front to the gun, and having a concentration (added a safety margin on account of inhomogenity) sufficient for effective screening. This means that the shorter distance between the gun and the cloud front (in this case the smoke points) the lager dosage is necessary fr achieving screening at a given wind speed. Dosage quantities are discussed later in this disclosure.

Assuming that the wind direction is towards the incoming laser beam, automatic activation will still connect the same nozzles as mentioned previously. In this case the wind lead the smoke cloud away from the gun. This will thereby not be surrounded by the smoke. The wind direction registering apparatus 10, FIG. 1, registers this fact and activates to operation modus that nozzle system which is lying upwind. After a short period the previously activated system which was triggered by the laser beam, is thus disconnected. The upwind nozzle system will hereafter take over the smoke screening of the cannon. By manual activation this nozzle system will be activated directly.

During a pre-combatting it is not to be disregarded that our air defence fails and that the enemy via areal weapons will go into a preparative attack of the fortress. This may conceivably be carried out inter alia to clear away camuflage and possible dummies which are not sufficiently sturdy. Registration equipment such as laser warners and wind measuring equipment may also be put out of commission during this preparation. By total destruction, i.e. when the back-up systems have been destroyed as well, the operating unit for the smoke system will automatically give a signal about this. The smoke system may then only be activated manually. The nozzles may in this emergency situation be controlled by the latest registered wind data. If wanted/necessary one may also prepare the possibility for supplying manually the operating unit with assumed data for wind speed and direction. However, the connection points for the laser warners and wind measuring equipment must be so sufficiently robust and simple that personnell may go out between the attacks to easily replace them if required.

Concerning the vulnerability of the disclosed smoke system this may according to the claim relatively readily be made less than the gun itself.

Smoke material

When choosing smoke material for use in battle this must exhibit an acceptable screening capability both in the visible and the infra red spectrum. To avoid a too strong marking of the fortress, the smoke should additionally as much as possible to coincide with the surroundings in the two spectra. Brass powder as a smoke material will to an acceptable degree fulfill these requirements. This smoke is cold and will thus only give a weak signal in IR. In the visible spectrum the smoke will gainst a background of clear fields or sea appear relatively weakly (brownish colour). During winter this should neither be a problem since the situation of most coastal fortifications usually represents a terrain being partly covered by snow.

An inadvertent inhalation of brass powder gives no toxic symptoms. How repeated exposures over time will affect personnell and environment is uncertain. It is thus recommended that the smoke material only exceptionally is used during practice in peace time. Instead, one should use a material which may be emitted through the original nozzles without using extra equipment. The material must further not give any acid reaction with water. It must additionally be environmentally acceptable. Powder which fulfill these requirements and which is recommended used is:

ammonium sulphate ($(NH_4)_2SO_4$)

ammonium hydrogen phosphate ($(NH_4)_2HPO_4$)

Initially the smoke material may be spread from nozzles being situated in four spreading points (smoke points) A, B, C and D, see FIG. 3, about the gun. A suggestion for a spreading plan with a nozzled arrangement and a compass rose is also shown in the Figure. If it is operated with four nozzles simultaneously, each smoke point ought to operate with two supply conduits with a regulation valve 25, FIG. 2, on each supply conduit. For example in FIG. 3, point A, the nozzles $A_2$ and $A_3$ will be connected to one conduit, and the nozzles $A_1$ and $A_4$ to the other. Which nozzles to connect will depend on the direction of the wind. For example with a wind direction between 325° and 375° (cfr. the compass rose in FIG. 3) the nozzles $A_2$, $A_3$, $B_1$ and $B_4$ will be activated. A wind direction between 375° and 25° will signify activation of all four nozzles in point A. Upon laser warning during an attack with laser-guided rockets, the four nozzles giving best cover between rocket and cannon will be activated irrespective of the direction of the wind. However, after a short period the smoke emittance will be altered to the four nozzles lying upwind. Based on the fewest possible nozzles under simultaneous operation, one will probably be able to achieve an acceptable level concerning consumption of smoke material and pressurized air.

A distribution of smoke points as shown in FIG. 3, will probably not be feasible in steep hills/cliffs close to the guns. (If one is not to place the smoke points on high stands above the ground with a correspondingly increased vulnerability.) The terrain will then determine the situation of the smoke points. The number of smoke points, distance between the points and the gun, number of nozzles per smoke point and their emitting direction, will then be parameters which may be varied to achieve acceptable coverage from all directions. An example of a smoke system with only two smoke points being situated close to the cannon is sketched in FIG. 4.

Smoke material concentrations

When evaluating the smoke system concept it will be informative to know approximately what quantities of brass powder which must be emitted per time unit to give a covering smoke screen. A sufficiently good estimate may be done by using the so-called Lambert-Beer's Law:

$$T_1/T_0 = e^{-\alpha.C.L} \tag{4.1}$$

C: the concentration of smoke material ($g/m^3$) (homogenous smoke cloud)

L: distance of irradiation through the cloud (m)

$\alpha$: extinction coefficient ($m^2/g$)

Figure 5:
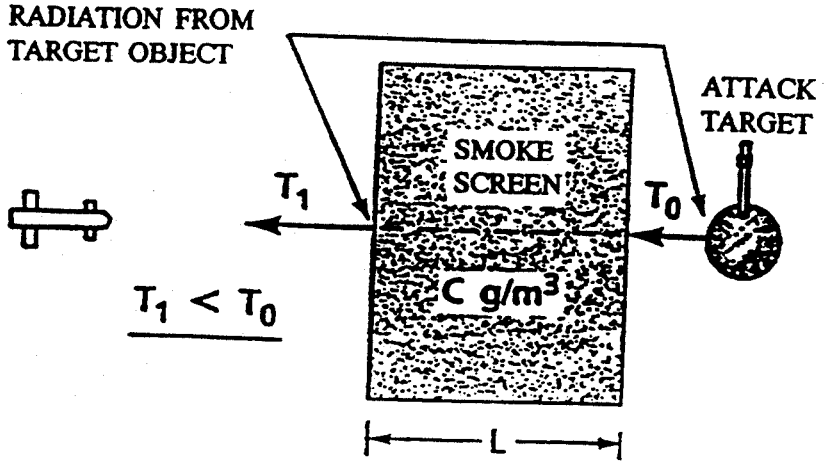
FIG. 5 shows an illustration of the law of Lanbert-Beer, cfr. equation (4.1).

$T_1/T_0$: ratio between irradiation intensities, see FIG. 5.

According to experience it is difficult to presume that screening occurs when $T_1/T_0 \leqq 0.05$, i.e. when:

$$C \geqq -(l_n 0.05)/(\alpha.\ L) \tag{4.2}$$

In the following concentrations of smoke material in smoke clouds for screening against laser- and IR-homing rockets is more throughly evaluated.

Screening against IR-homing rockets

The probability for an IR-homing rocket to obtain targetting of an object screened by a smoke cloud is dependent on the target-seeking device, the target contrast, K, (against the background), and the ratio of emitted irrdiation from the target getting through the smoke screen ($T_1/T_0$). The requirement for screening is that the target contrast K being registered by the targetting device through the cloud of smoke is less or equal to a limit value $K_g$, i.e. $K \leqq K_g$.

The contrast may be expressed by the equation:

$$k = \frac{1}{1 + \frac{S_{SK}}{(T_1 T_0) \cdot S_B}} \cdot \frac{(S_M - S_B)}{S_B} \approx C_0 \tag{4.3}$$

$$K \approx (T_1/T_0) \cdot (S_B/S_{SK}) \cdot K_0, \text{ when } (T_1/T_2) \leqq 1/4 \tag{4.4}$$

$S_M$ : The radiance ($W/sr.M^2$) from the target object $S_B$ : The radiance from the background $S_{SK}$ : The radiance from the smoke cloud (diffracted/reflected sun radiation)

$K_0$ : Target contrast without smoke

In this very crude estimate of the concentration of the smoke material equation (4.2) may be used directly. If it is presured that the irradiation distance through the cloud is 16 m one will find the following relation when substituting in equation (4.2):

$$C_{screening} \leqq 0{,}1872/(\alpha(\lambda)) \tag{4.5}$$

The extinction coefficient $\alpha(\lambda)$ for brass powder will not only vary between the types. Also the spreading method will give a variation in $\alpha(\lambda)$. The brass powder consists of metal flakes with a diameter of 3–10 $\mu$m and a thickness of 0.1–0.5 $\mu$m. After spreading the flakes will be grouped in small agglomerates with warying diameters. The greater the splitting during the emittance the more effective IR-screening per weight unit of smoke material. Maximum screening efficiency is achieved if all the metal flakes are separated when airborne.

Figure 6:
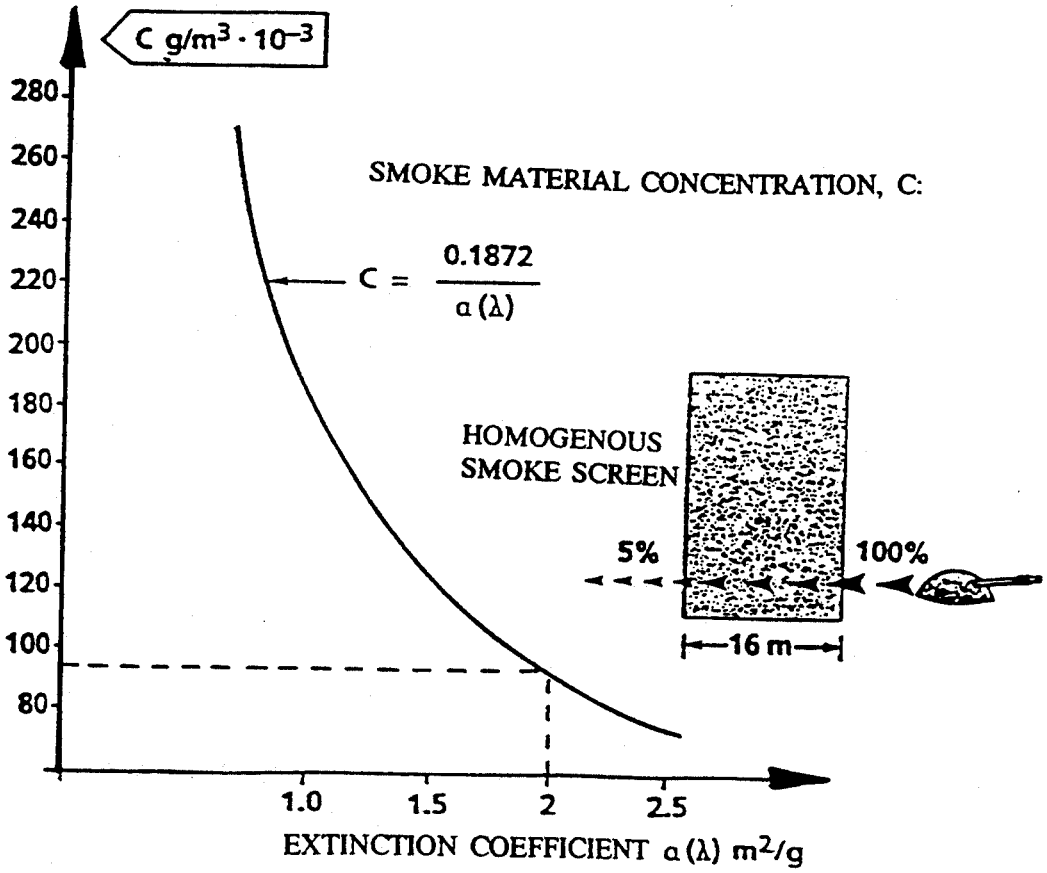
FIG. 6 shows the smoke material concentration, C, in a homogenous cloud of smoke as a function of the extinction coefficient $\alpha(\lambda)$ to stop 95% of the incoming radiation towards a cloud with a depth of 16 m.

In FIG. 6 the required powder concentration for 95% absorption/spreading or IR-radiation through a cloud with a depth of 16 m is specified as a function of the extinction coefficient $\alpha(\lambda)$, see equation (4.5).

In a homogenous cloud of smoke which for instance is 40 m wide, 5 m high and 16 m deep, it will totally be necessary with 300 g brass powder ($\alpha(\lambda)=2\ m^2/g$) to reduce the transmission to 5%. This means that theoretically it must be blown out 30 g powder per second (evenly dispersed over 200 $m^2$) if the requirement for establishment time is 10 s. (In practice this quantity must be increased , maybe to double the amount on account of uneven spreading.) The condition is that the emittance of brass powder takes place on that side of the gun which is upwind, with a wind velocity of 1.6 m/s (i.e. the wind blows the powder towards the gun, and during 10 s the wanted cloud depth of 16 m will be achieved).

If the wind velocity is greater, then the emitted material quantity must increase proportionally with the wind velocity. A simple curve showing this relationship is shown in FIG. 7.

Figure 7:
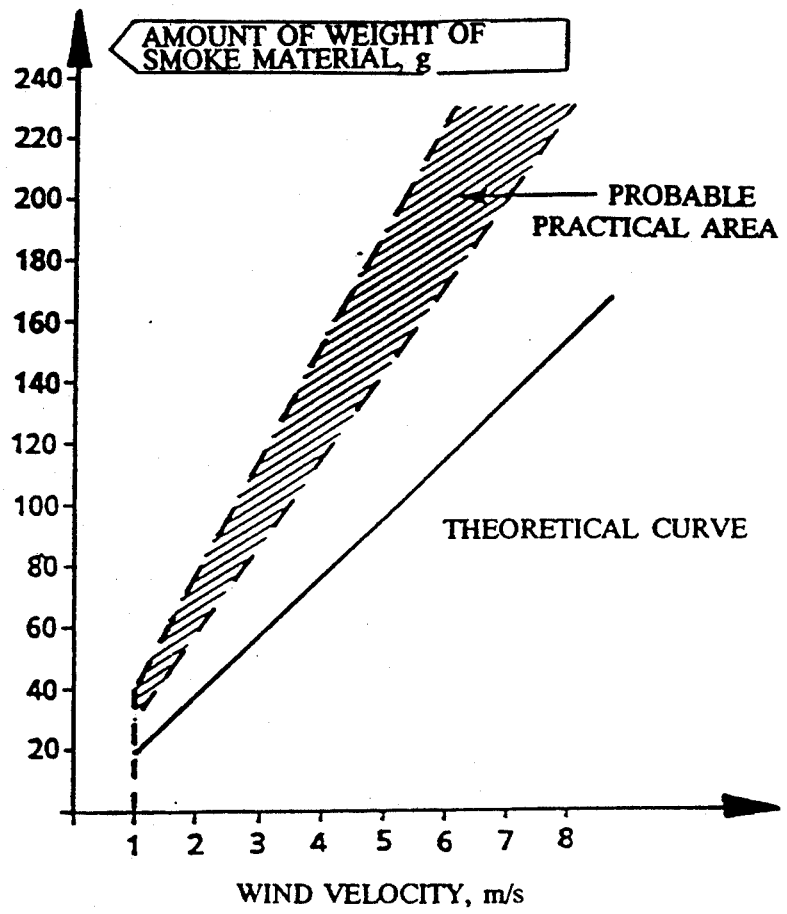
FIG. 7 shows the weight quantity of smoke material ($\alpha(\lambda)=2\ m^2/g$) blown per second as a function of wind speed (emitted smoke from nozzles lying on the "wind side" of the gun) to establish a cloud of smoke covering an area of 200 $m^2$.

FIG. 7 shows the weight quantity of smoke material ($\alpha(\lambda)=2\ m^2/g$) blown per second as a function of the wind velocity (smoke emitted from nozzles lying "windside" of the cannon) to establish a smoke cloud with a coverage area of 200 $m^2$. The transmission rate in IR (8–12 μm) is 5% and establishment time 10 s. The front of the smoke cloud is 16 m from the cannon. The bottom curve specifies the quantity for a homogenous cloud of smoke (i.e. the minimum quantity). Within the marked area the probable practical quantity will lie (i.e. inhomogenous spreading).

FIG. 7 thus shows that a blown quantity of smoke material per second at wind velocities up to 8 m/s (being the limiting requirement) is very large. By increasing the distance, L, from the gun to the front of the smoke cloud, the emitted quantity per second may be reduced. In other words, on Coast Artillery (CA) forts where it is relatively often strong wind, the nozzles ought, if possible, not to be situated too close to the gun.

Screening against laser-homing rockets

As disclosed initially laser-guided weapons with ground-situated designators are the most serious threat both today and still some years to come. Smoke-screening against these weapons will be treated in the following.

Figure 8:
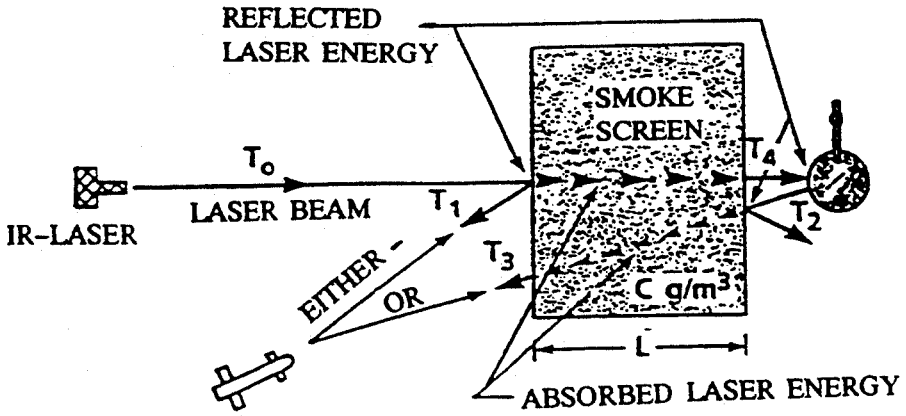
FIG. 8 shows the reflection and absorption of a laser beam with a depth of 16 m as a function of the extinction coefficient, $\alpha(\lambda)$, of the brass-powder smoke.

One may contemplate that a CA-gun is irradiated by laser through a thin cloud of metallic powder (transparent in the visible spectrum). The laser beam becomes thereby weakened both through reflection and absorption in the path forth and back through the smoke cloud. This is illustrated in FIG. 8 showing the reflection and absorption of a laser beam when illuminating an attack target being covered by a smoke cloud. A rocket will home on reflected laser energy either from the smoke cloud or from the gun.

The rocket may home upon the reflected irradiation from the target getting through after the cloud (absorption), see FIG. 8.

To get an understanding about the concentration range for a smoke screen meant to screen for laser homing, one may calculate the concentration giving $T_1=T_3$, FIG. 8. To achieve coverage the smoke material concentration must, however, be larger than the value giving $T_1=T_3$.

Evaluations

According to information from USA $T_1=0.15T_O$. Albedo for a brass powder cloud is approx. 0.15.

$$\text{When } T_1=T_3, \text{ then } T_3=0.15T_0. \tag{4.8}$$

From equation (4.1) one finds:

$$T_3=0.75^2\cdot T_0\cdot e^{-2(\alpha(\lambda)\cdot 16\cdot C)} \tag{4.9}$$

It is here presupposed that the depth of the smoke cloud, L, is 16 m. The equations (4.8) and (4.9) give $$\alpha 15T_0=0.75^2 To\cdot e^{-2(\alpha(\lambda)\cdot 16\cdot C)}$$

$$c=0.0413/\alpha(\lambda) \tag{4.10}$$

Figure 9:
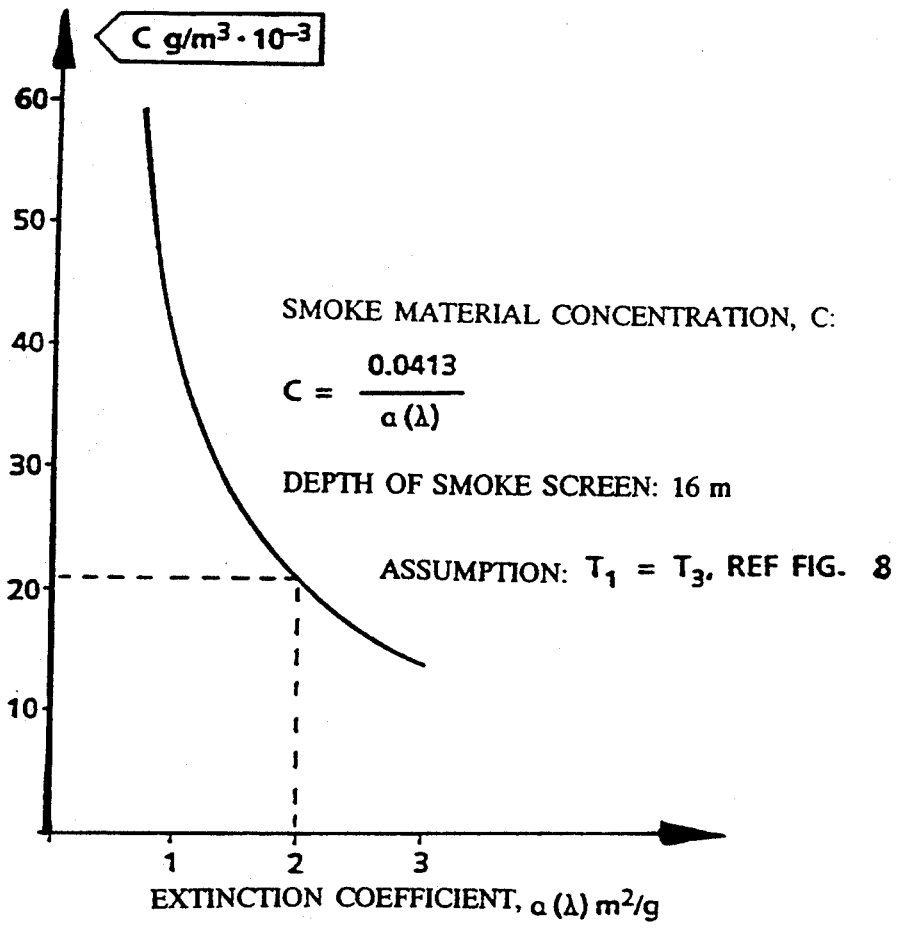

The curve in FIG. 9 shows the smoke material concentration, C, in a smoke cloud with a depth of 16 m, as a function of the extinction coefficient, $\alpha(\lambda)$, of the brass powder cloud. A realistic value for $\alpha(\lambda)$ is 2 $m^2/g$. The curve specifies the concentration where reflected laser energy in the front of the smoke cloud equals the reflected energy which the rocket will receive from the cannon, i.e. $T_1=T_3$, cfr. FIG. 8. This leads to a smoke material concentration of 20 $mg/m^3$ (or ¼ of the smoke material concentration for IR-screening, FIG. 5). To achieve screening in practice it is probable that this concentration must be increased with a factor of 1.5–2, corresponding to 30–40 $mg/m^3$.

To find the emitted smoke quantity per second as a function of wind speed for laser screening, the values found from the curve on FIG. 7 for IR-screening may be used. These values must, however, be reduced with approx. 75% to lead to the concentrations corresponding to the equation (4.10).

Field tests

There have been performed preliminary tests of emitting powder charges. The equipment which was used is a common sand-blowing apparatus, type SEV-25, attached to a high pressure compressor (capacity: 20 $m^3$/min expelled air quantity at 20 bars).

There were effected tests with brass powder and titanium oxyde, $TiO_2$, for simulating rehersal smoke. Titanium oxide was used for lack of the suggested rehersal smoke charge based on a mixture of ammonium sulphate and ammonium hydrogen phosphate.

When emitting pure brass powder the range of the powder cloud was unacceptably short for all nozzles. In addition there was too poor "flow" in the powder resulting in an uneven feeding to the nozzle (one had to shake the fedding container). To alleviate these problems the brass powder was mixed with a sand-blowing material in the ratio 1:10 and 1:6. The result was that the range of the blown powder cloud increased considerably (30–40 m). In addition there was achieved good flow of the powder with an even feeding to the nozzle.

At one of the tests with a first type of a nozzle the smoke charge was fed relatively quickly into the nozzle. Air pressure and —flow was 5–6 bars and 3.0–3.4 $m^3$/min, respectively.

When testing with another nozzle there was used a ratio of brass powder/sand blowing material of 1:6. Air pressure and flow was 5–6 bars and 6.0–7.3 $m^3$/min, respectively. The result was a smoke cloud (after finished blowing) which probably still would screen effectively against laser illumination and IR-homing When testing with a third nozzle the mixture ratio powder/-sand was equal to 1:10. Air pressure and flow was 6–8 bars and 6.5–7.5 $m^3$/min, respectively.

The explanation for the greater range being achieved with the addition of grains of sand into the powder, is probably that metal powder flakes being absorbed/adhered to the grains of sand (initial velocity approx. 350 km/h) "peels" off in the air. In addition flakes being already airborne will be "sucked" along by the turbulence from following grains of sand.

The spreading of $TiO_2$ was also treated with addition of grains of sand in the ratio 1:10.

The wind during the tests was very weak with a direction "inclined" against the emitting direction. The spreading was thus performed under relatively favourable conditions.

It is to be understood that there might also be used other compositions of active screening materials with suitable quantities of inert solid particles with good cold-flowing properties as more closely generalized and defined in the attached patent claims.

Thus a mixture of sand + brass powder will give a screening in the visible range and IR-range.

A mixture of sand + brass powder + mm-Chaff will give a screening in the visible range, IR- and mm-wave range up to 10–15 mm.

A mixture of sand + a specially developed screening material +for instance $TiO_2$ will give a screening in the visible range, IR- and mm-wave range.

I claim:

1. Device in a smoke screening system comprising: emitting means for emitting a screening smoke comprising active screening materials in the form of at least one metallic powder and a material comprising inert solid particles with good cold-flowing properties for diluting the active screening material and for improving the cold-flowing properties of the active screening material, said emitting means comprising at least one nozzle for emitting at least one spreading cloud of said screening smoke.

2. Device according to claim 1, wherein the active screening materials comprise a metallic powder for screening in the IR-range of 3–12 μm, may be aluminum-coated glass-fiber needles with a length distribution which especially gives a simultaneous screening both in the 36 GHz range and in the 94 GHz range, or an additive which simultaneously gives a screening both in the IR-range and the mentioned spectra in the mm-wave range, possibly combined with with a powder, e.g. $TIO_2$, increasing the screening in the visible range, and where there simultaneously in all said mixtures is used inert solid particles with good cold-flowing properties, e.g. particles of aluminum silicate, of diluting and improving the cold-flowing properties of the active smoke charge composition.

3. Device according to claims 1, the screening smoke comprises a mixture of metallic powder and a sand blowing material in a ratio from about 1:2 to 1:5.

4. Device according to claim 3 wherein the sand blowing material comprises particles in the size range 0.6 to 1.5 mm, and selected from the group consisting of crushed aluminum silicate particles with a specific gravity of about 2.0, cast-iron sand with a specific gravity of 6 to 7, aluminum oxide with a specific gravity of 3.0, crushed slag from iron production, and crushed olivine slag.

5. Device according to claim 1, wherein a plurality of smoke points are situated around an object to be screened, each smoke point comprising at least one or more nozzles for spreading smoke in different directions.

6. Device according to claim 5 wherein the at least one nozzle of each smoke point is connected to a supply conduit which is connected by means of an adjustable valve to a compressor for a pressure fluid and a storage unit for smoke material.

7. Device according to claim 6, wherein the valves of the conduits are connected to a control unit which includes a) means for manual switching on and off, b) means for automatic switching on in response to remotely produced signals, and c) a device for measuring meteorological data.

8. Device according to claim 7, wherein said means for automatic switching on is directly connected to a strategic object which is to be screened and comprising a laser beam activated device which is connected to automatically activate a corresponding smoke point in response to laser illumination from an attacking post.

9. Device according to claim 6, wherein for each object to be screened there are provided at least two smoke points, and wherein for each smoke point there are provided four nozzles.

10. Device according to claim 6, wherein the controllable valves in the supply conduits control the emitting of screening smoke as a function of the number of smoke points, the distance of the smoke points from the object which is to be screened, the number of nozzles per smoke point, and the emitting direction of the nozzles, as related to initial screening by automatic triggering of the smoke screening system and to the prevailing wind conditions upon and after activation of the system, and in consideration of optimal spreading for distracting the attacking target, but without unnecessary concentrated smoke screening for minimum marking of the area where the objects are situated.

11. Device according to claim 1 wherein said at least one nozzle is of a type used in connection with sand blowing devices and said emitting means further includes a high pressure compressor.

12. Device according to claim 1 wherein the device, during practice operations, emits smoke powder comprising ammonium sulphate ($(NG_4)\ _2SO_4$) and ammonium hydrogen phosphate ($(NH_4)_2HPO_4$) for simulating practice smoke.

13. A device according to claim 1 wherein said metallic powder comprises a brass powder.

14. A device according to claim 1 wherein said inert solid particles comprise aluminum silicate particles.

15. A device according to claim 14 wherein said inert solid particles further comprise a sand blowing material.

16. A device according to claim 1 wherein said inert solid particles comprise a sand blowing material.

17. A device according to claim 1 wherein said nozzle comprises a high pressure nozzle.

18. A device according to claim 2 wherein said active screening powders comprise a metallic powder for screening in the IR-range of 3-μm, and mm-wave chaff.

19. A device according to claim 1 wherein said active screening particles comprise mm-wave chaff comprising aluminum-coated glass-fibre needles with a length distribution which provides a simultaneous screening both in the 36 GHz range and in the 94 GHz range.

20. A device according to claim 1 wherein the active screening materials include an additive which simultaneously provides screening both in the IR-range and in the mm-wave range.

21. A device according to claim 20 wherein said additive is further combined with powder for increasing screening in the visible range.

22. A device according to claim 11 wherein said high pressure compressor has a capacity of 20 $m^3$/min emitted air quantity at 20 bars and wherein each nozzle is supplied at a pressure in the range of 5 to 6.5 bars and having a flow quantity of about 3.0 to 7.5 $m^3$/min, the smoke having an initial velocity of about 350 km/h.

* * * * *